US009365375B2

(12) United States Patent
Aoki

(10) Patent No.: US 9,365,375 B2
(45) Date of Patent: Jun. 14, 2016

(54) IMAGE FORMING APPARATUS

(71) Applicant: Konica Minolta, Inc., Chiyoda-ku, Tokyo (JP)

(72) Inventor: Shingo Aoki, Tokyo (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/089,214

(22) Filed: Nov. 25, 2013

(65) Prior Publication Data

US 2014/0145397 A1 May 29, 2014

(30) Foreign Application Priority Data

Nov. 28, 2012 (JP) ..... 2012-259712

(51) Int. Cl.
*B65H 7/10* (2006.01)
*B65H 9/00* (2006.01)
(Continued)

(52) U.S. Cl.
CPC ..... *B65H 9/002* (2013.01); *B65H 7/10* (2013.01); *B65H 9/103* (2013.01); *B65H 9/20* (2013.01); *G03G 15/65* (2013.01); *B65H 2301/3613* (2013.01); *B65H 2404/1424* (2013.01); *B65H 2404/14212* (2013.01); *B65H 2511/24* (2013.01); *B65H 2511/242* (2013.01); *B65H 2553/42* (2013.01); *B65H 2701/1311* (2013.01); *B65H 2701/1315* (2013.01); *B65H 2801/06* (2013.01)

(58) Field of Classification Search
CPC ..... B65H 7/10; B65H 9/002; B65H 9/103; B65H 2301/3613; B65H 2404/1424; B65H 2511/242
USPC ..... 271/228, 248–250, 252
See application file for complete search history.

(56) References Cited

U.S. PATENT DOCUMENTS 4,823,159 A * 4/1989 Yamamoto et al. ..... 399/394
5,362,041 A * 11/1994 Ryuzaki et al. ..... 271/236
(Continued)

FOREIGN PATENT DOCUMENTS

JP 06-040608 A 2/1994
JP 2000280554 A 10/2000
(Continued)

OTHER PUBLICATIONS

Japanese Notification of Reasons for Refusal corresponding to Patent Application No: 2012-259712; Date of Mailing: Nov. 11, 2014, with English translation.
(Continued)

*Primary Examiner* — Patrick Cicchino
(74) *Attorney, Agent, or Firm* — Cantor Colburn LLP

(57) ABSTRACT

An image forming apparatus reflecting one aspect of the present invention includes a deviation detecting portion, a registration roller, and a leading end detecting portion. The deviation detecting portion detects a deviation amount of the sheet being fed from a reference position in a sheet width direction orthogonal to a feeding direction. The registration roller modifies deviation by swinging the sheet being fed in the sheet width direction in accordance with the deviation amount detected by the deviation detecting portion. The leading end detecting portion is disposed on the downstream side in the sheet feeding direction of the registration roller and detects a leading end of the sheet being fed. The leading end detecting portion detects the leading end of the sheet after deviation is modified by the registration roller.

3 Claims, 7 Drawing Sheets

(51) Int. Cl.

| | |
|---|---|
| ***B65H 9/20*** | (2006.01) |
| ***B65H 9/10*** | (2006.01) |
| ***G03G 15/00*** | (2006.01) |

(56) References Cited

U.S. PATENT DOCUMENTS

| | | | | |
|---|---|---|---|---|
| 7,677,558 | B2 * | 3/2010 | Kinoshita et al. | 271/227 |
| 7,722,039 | B2 * | 5/2010 | Shoji et al. | 271/273 |
| 8,342,517 | B2 * | 1/2013 | Kinoshita et al. | 271/228 |
| 8,814,163 | B2 * | 8/2014 | Yamagata | 271/270 |
| 2005/0035528 | A1 * | 2/2005 | Suga et al. | 271/10.12 |
| 2008/0232879 | A1 * | 9/2008 | Shoji et al. | 399/395 |
| 2008/0251998 | A1 * | 10/2008 | Muneyasu et al. | 271/227 |
| 2009/0033030 | A1 * | 2/2009 | Yasumoto | 271/278 |
| 2013/0285315 | A1 * | 10/2013 | Deno | 271/226 |

FOREIGN PATENT DOCUMENTS

| | | | |
|---|---|---|---|
| JP | 2008024507 | A | 2/2008 |
| JP | 2008242395 | A | 10/2008 |
| JP | 2008254843 | A | 10/2008 |
| JP | 2009057130 | A | 3/2009 |
| JP | 2009126670 | A | 6/2009 |

OTHER PUBLICATIONS

Japanese Notification of Reasons for Refusal corresponding to Application No. 2012-259712; Dispatch Date: Feb. 23, 2016, with English translation.

* cited by examiner

IMAGE FORMING APPARATUS

CROSS REFERENCES TO RELATED APPLICATIONS

The present invention contains subject matter related to Japanese Patent Applications JP 2012-259712, filed in the Japanese Patent Office on Nov. 28, 2012, respectively, the entire contents of which being incorporated herein by reference.

BACKGROUND OF THE INVENTION

1. Field of the Invention

The present invention relates to an image forming apparatus provided with a registration roller.

2. Description of the Related Art

In general, an image forming apparatus, in order to transfer a toner image formed on a photoreceptor to a sheet with accuracy, stops the sheet once at a nip portion of a registration roller pair immediately before the photoreceptor, and adjusts a position of a leading end of the sheet and feeding timing. Then, the registration rollers are rotated based on transfer timing of the toner image, and the sheet nipped between the registration roller pair is fed out to a transfer position.

As described above, in order to position the leading end of the sheet, the leading end of the sheet being fed from an upstream part of a feeding path is brought into contact with the registration roller pair, and the sheet is stopped. In the image forming apparatus having the registration roller, a mechanism for allowing the registration roller to slide in a sheet width direction and a means for detecting a position of a side end part of the sheet in parallel with a feeding direction of the sheet are provided, and the side end parts of the sheet are positioned in a main scanning direction (sheet width direction).

Patent Literature 1, for example, describes a paper feeding device having a resist photosensor for detecting a leading end of a sheet (transfer paper), which is mounted integrally with the pair of registration rollers.

FIG. 9 is a flowchart illustrating an outline of paper feeding processing by the paper feeding device described in Patent Literature 1.

In the paper feeding device described in Patent Literature 1, when a sheet is supplied from a paper feeding stage and paper passing is started (Step S101), the resist photosensor performs detection of a leading end of the sheet being fed (Step S102). When the resist photosensor detects the leading end of the sheet, the paper feeding device brings the leading end of the sheet into contact with the pair of registration rollers and stops the sheet and then, causes the leading end of the sheet to enter the nip portion formed at the registration rollers (S103). Here, when a side-end detection sensor in the paper feeding device detects deviation of the sheet from a reference position in the sheet width direction (Step S104), the paper feeding device swings the registration rollers until the deviation is not detected any longer (Step S105). After the swing of the registration rollers is finished, the paper feeding device feeds the sheet to the transfer position (Step S106). At the transfer position, a toner image is transferred to the sheet (Step S107).

Patent Literature 1: Japanese Patent Laid-Open No. 06-40608

SUMMARY OF THE INVENTION

Problems to be Solved by Invention

However, if the leading end of the sheet is detected immediately before swing of the registration roller pair as described in Patent Literature 1, when the sheet has already deviated before reaching the registration roller pair, a detected position of the sheet leading end in the sheet width direction might be different from the detected position without deviation. If the sheet has been fed at a high speed, skew of the sheet (a state in which the side end portions of the sheet are not in parallel with the feeding direction) cannot be corrected at the nip portion of the registration roller pair in some cases. If the leading end of the sheet is detected with the skew remaining, the detected positions of the sheets are varied in the sheet width direction, and the positions of the toner images transferred on the sheets by the transfer portion become varied, too.

Moreover, for a period until a swing speed becomes constant immediately after start of the swing of the registration roller pair, the registration roller pair is in a state accelerating in the sheet width direction. In general, in an electric motor such as a motor used as a roller driving portion, acceleration or a change rate of acceleration is not necessarily stable until the speed reaches a constant speed after the operation is started. That is, a swing amount of the registration roller pair until the swing speed becomes constant is not stable. Thus, if the leading end detection sensor detects the leading end of the sheet while the registration roller pair is accelerating in the sheet width direction, a moving amount of the sheet in the sheet width direction after the leading end is detected is not stable. As a result, even if the sheets of the similar type and size are continuously passed, the position or timing of the leading end of the sheet read by the leading end detection sensor in the sheet width direction becomes different for each sheet. Therefore, the positions of the toner images and the sheets at the transfer position are varied.

The present invention was made in view of the above circumstances and has an object to reduce variation in a detected position or detection timing of the leading end of the sheet in the sheet width direction.

Means for Solving the Problem

In order to achieve the aforementioned object, the image forming apparatus reflecting one aspect of the present invention includes a deviation detecting portion, a registration roller, and a leading end detecting portion.

The deviation detecting portion detects a deviation amount from a reference position in the sheet width direction orthogonal to the feeding direction of the sheet being fed.

The registration roller modifies the deviation by swinging the sheet being fed in the sheet width direction in accordance with the deviation amount detected by the deviation detecting portion.

The leading end detecting portion is disposed on the downstream side in the sheet feeding direction of the registration roller and detects the leading end of the sheet being fed.

Then, the leading end detecting portion detects the leading end of the sheet after the deviation is modified by the registration roller.

DESCRIPTION OF THE PREFERRED EMBODIMENTS

Figure 1:
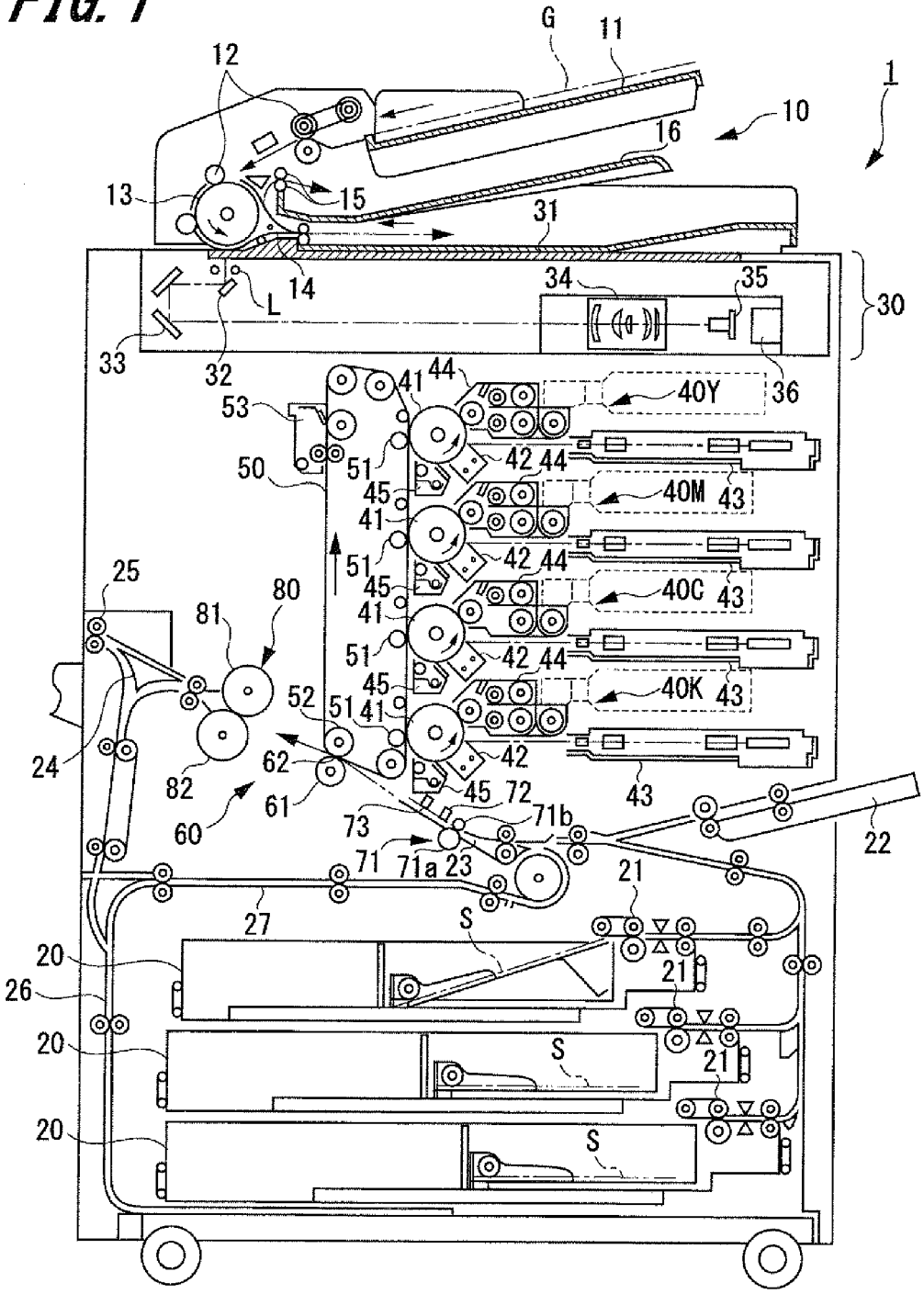
FIG. 1 is an entire configuration diagram illustrating an image forming apparatus according to an embodiment of the present invention.

An image forming apparatus according to an embodiment of the present invention will be described below by referring to FIGS. 1 to 8. The same reference numerals are given to common members in each figure.

[Configuration Example of Image Forming Apparatus]

First, an outline of an image forming apparatus according to the embodiment of the present invention will be described by referring to FIG. 1.

FIG. 1 is an entire configuration diagram illustrating the image forming apparatus according to the embodiment of the present invention.

As illustrated in FIG. 1, an image forming apparatus 1 forms an image on a sheet in an electrophotography method and is a tandem-type color image forming apparatus overlapping four colors, that is, yellow (Y), magenta (M), cyan (C), and black (Bk) with each other. This image forming apparatus 1 has a manuscript feeding portion 10, a sheet accommodating portion 20, an image reading portion 30, an image forming portion 40, an intermediate transfer belt 50, a secondary transfer portion 60, and a fixation portion 80.

The manuscript feeding portion 10 has a manuscript feeding platen 11 on which a manuscript G is set, a plurality of rollers 12, a feeding drum 13, a feeding guide 14, a manuscript discharge roller 15, and a manuscript discharge tray 16. The manuscript G set on the manuscript feeding platen 11 is fed one by one to a reading position of the image reading portion 30 by the plurality of rollers 12 and the feeding drum 13. The feeding guide 14 and the manuscript discharge roller 15 discharge the manuscript G fed by the plurality of rollers 12 and the feeding drum 13 to the manuscript discharge tray 16.

The image reading portion 30 reads an image of the manuscript G fed by the manuscript feeding portion 10 or the manuscript placed on a manuscript platen 31 and creates image data. Specifically, the image of the manuscript G is illuminated by a lamp L. Reflective light from the manuscript G is led to a first mirror unit 32, a second mirror unit 33, and a lens unit 34 in this order and forms an image on a light receiving surface of an image pickup element 35. The image pickup element 35 photoelectrically converts incident light and outputs a predetermined image signal. The outputted image signal is A/D converted and created as image data.

Moreover, the image reading portion 30 has an image reading control portion 36. The image reading control portion 36 applies processing such as shading correction, dither processing, compression and the like to the image data created by A/D conversion and stores the result in a RAM 103 (See FIG. 2) of a control portion 100. The image data is not limited to data outputted from the image reading portion 30 but may be those received from an external device such as a personal computer connected to the image forming apparatus 1 or other image forming apparatuses.

The sheet accommodating portion 20 is disposed on a lower part of the apparatus main body and provided in plural in accordance with the size or type of the sheet. This sheet is supplied by a paper feeding portion 21 and fed to a feeding portion 23 and is fed by the feeding portion 23 to a secondary transfer portion 60 having a transfer position. Moreover, a manual insertion portion 22 is provided in the vicinity of the sheet accommodating portion 20. From this manual insertion portion 22, a sheet having a size not accommodated in the sheet accommodating portion 20, tag paper having a tag, and special paper such as OHP sheets are fed to the transfer position. In FIG. 1, reference character S is given to a sheet fed by the paper feeding portion 21.

Between the image reading portion 30 and the sheet accommodating portion 20, the image forming portion 40 and the intermediate transfer belt 50 are arranged. The image forming portion 40 has four image forming units 40Y, 40M, 40C, and 40K for forming a toner image in each color of yellow (Y), magenta (M), cyan (C), and black (Bk).

The first image forming unit 40Y forms a yellow toner image, and the second image forming unit 40M forms a magenta toner image. Moreover, the third image forming unit 40C forms a cyan toner image, and the fourth image forming unit 40K forms a black toner image. Since these four image forming units 40Y, 40M, 40C, and 40K have the same configuration, the first image forming unit 40Y will be described here.

The first image forming unit 40Y has a drum-shaped photoreceptor 41, a charging portion 42, an exposing portion 43, a developing portion 44, and a cleaning portion 45 arranged in the periphery of the photoreceptor 41. The photoreceptor 41 is rotated by a driving motor, not shown. The charging portion 42 gives charges to the photoreceptor 41 and uniformly charges the surface of the photoreceptor 41. The exposing portion 43 performs an exposing operation on the surface of the photoreceptor 41 on the basis of image data read from the manuscript G or image data transmitted from an external device and forms an electrostatic latent image on the photoreceptor 41.

The developing portion 44 makes a yellow toner adhere to the electrostatic latent image formed on the photoreceptor 41 by using a binary developing agent made of a toner and a carrier, for example. As a result, a yellow toner image is formed on the surface of the photoreceptor 41.

The developing portion 44 of the second image forming unit 40M makes a magenta toner adhere to the photoreceptor 41, and the developing portion 44 of the third image forming unit 40C makes a cyan toner adhere to the photoreceptor 41. The developing portion 44 of the fourth image forming unit 40K makes a black toner adhere to the photoreceptor 41.

The toner image formed on the photoreceptor 41 is transferred onto the intermediate transfer belt 50 which is an example of an image carrier. The intermediate transfer belt 50 is formed in an endless form and wound around a plurality of rollers. This intermediate transfer belt 50 is rotated and driven in a direction opposite to a rotating (moving) direction of the photoreceptor 41 by a driving motor, not shown.

The cleaning portion 45 removes the toner remaining on the surface of the photoreceptor 41 after the toner image is transferred onto the intermediate transfer belt 50.

At the position facing the photoreceptor 41 of each of the image forming units 40Y, 40M, 40C, and 40K in the intermediate transfer belt 50, a primary transfer portion 51 is provided. This primary transfer portion 51 primarily transfers the toner image formed on the photoreceptor 41 to the intermediate transfer belt 50 by applying a voltage having a polarity opposite to that of the toner to the intermediate transfer belt 50.

By means of rotation and driving of the intermediate transfer belt 50, the toner images formed by the four image forming units 40Y, 40M, 40C, and 40K are sequentially transferred onto the surface of the intermediate transfer belt 50. As a result, on the intermediate transfer belt 50, the toner images in yellow, magenta, cyan and black are overlapped and a color toner image is formed.

Moreover, a belt cleaning device 53 faces the intermediate transfer belt 50. This belt cleaning device 53 cleans the surface of the intermediate transfer belt 50 after finishing transfer of the toner image to the sheet.

In the vicinity of the intermediate transfer belt 50 and on the downstream in the sheet feeding direction of the feeding portion 23, a secondary transfer portion 60 is disposed. The sheet fed to the secondary transfer portion 60 might be dislocated and deviated to either side in the sheet width direction from a reference position in the sheet width direction (main scanning direction) by disturbance during feeding. In the image forming apparatus 1, in order to modify the deviation of the sheet, a registration roller pair 71 and a deviation detection sensor 72 are provided on the upstream side in the sheet feeding direction of the secondary transfer portion 60. Moreover, on the downstream side in the sheet feeding direction of the deviation detection sensor 72, a leading end detection sensor 73 is provided.

The secondary transfer portion 60 brings the sheet for which deviation has been modified by the registration roller pair 71 into contact with the intermediate transfer belt 50 and secondarily transfers the toner image formed on an outer peripheral surface of the intermediate transfer belt 50 to the sheet.

The secondary transfer portion 60 has a secondary transfer roller 61. The secondary transfer roller 61 is in pressure contact with a facing roller 52 with the intermediate transfer belt 50 sandwiched therebetween. A portion where the secondary transfer roller 61 and the intermediate transfer belt 50 are in contact is a secondary transfer nip portion 62. This secondary transfer nip portion 62 is a transfer position where the toner image formed on the outer peripheral surface of the intermediate transfer belt 50 is transferred to the sheet S.

On the discharge side of the sheet in the secondary transfer portion 60, the fixation portion 80 is provided. This fixation portion 80 fixes the transferred toner image to the sheet by pressurizing and heating the sheet. The fixation portion 80 is composed of a fixation upper roller 81 and a fixation lower roller 82 which are a pair of fixation members, for example. The fixation upper roller 81 and the fixation lower roller 82 are arranged in a pressure contact state with each other, and a fixation nip portion is formed as a pressure contact portion between the fixation upper roller 81 and the fixation lower roller 82.

Inside the fixation upper roller 81, a heating portion is provided. A roller portion located on an outer periphery portion of the fixation upper roller 81 is warmed by radiation heat from this heating portion. By means of transmission of the heat from the roller portion of the fixation upper roller 81 to the sheet, the toner image on the sheet is thermally fixed.

The sheet is fed such that the surface on which the toner image was transferred by the secondary transfer portion 60 (fixation target surface) faces the fixation upper roller 81 and passes through the fixation nip portion. Therefore, to the sheet passing through the fixation nip portion, pressurization by the fixation upper roller 81 and the fixation lower roller 82 and heat by the roller portion of the fixation upper roller 81 are applied.

On the downstream in the sheet feeding direction of the fixation portion 80, a switching gate 24 is disposed. The switching gate 24 switches a feeding path of the sheet having passed through the fixation portion 80. That is, the switching gate 24 allows the sheet to go straight in the case of face-up paper discharge in which the sheet is discharged with an image formed surface faced upward in one-sided image formation. As a result, the sheet is discharged by a pair of paper discharge rollers 25. Moreover, the switching gate 24 guides the sheet downward in the case of face-down paper discharge in which the sheet is discharged with the image formed surface faced downward in the one-sided image formation and double-sided image formation.

In the case of the face-down paper discharge, after the sheet is guided downward by the switching gate 24, the sheet is turned upside down by a sheet reversing feeding portion 26 and fed upward. As a result, the sheet turned upside down and having the image formed surface faced downward is discharged by the pair of paper discharge rollers 25.

In the case of the double-sided image formation, after the sheet is guided downward by the switching gate 24, the sheet is turned upside down by the sheet reversing feeding portion 26 and fed to the transfer position again by a paper refeeding path 27.

On the downstream side of the pair of paper discharge rollers 25, a post-treatment device such as folding the sheet, applying stapling processing or the like to the sheet may be disposed.

[Registration Roller Pair and Leading End Detection Sensor]

Here, a positional relationship of the registration roller pair 71 and the leading end detection sensor 73 will be described in detail.

The registration roller pair 71 is arranged in a state in which a driving roller 71*a* on the lower side and the driven roller 71*b* on the upper side are in pressure contact with each other while sandwiching the sheet feeding path, and shafts of the respective rollers are pivotally supported by bearing members, not shown, slidably in the axial direction, that is, the sheet width direction. Moreover, since the driving roller 71*a* and the driven roller 71*b* are in pressure contact, a nip portion is formed. The registration roller pair 71 moves in the sheet width direction by a swing driving portion (not shown) of a resist swing mechanism 70 (See FIG. 3) which will be described later. The swing driving portion can be composed of a rack and pinion mechanism and a driving motor rotating a pinion of this rack and pinion mechanism in forward and backward directions, for example. The driving roller 71*a* is rotated by a roller driving portion (not shown), and as a driving source of this roller driving portion, a stepping motor, for example, can be used.

Figure 2:
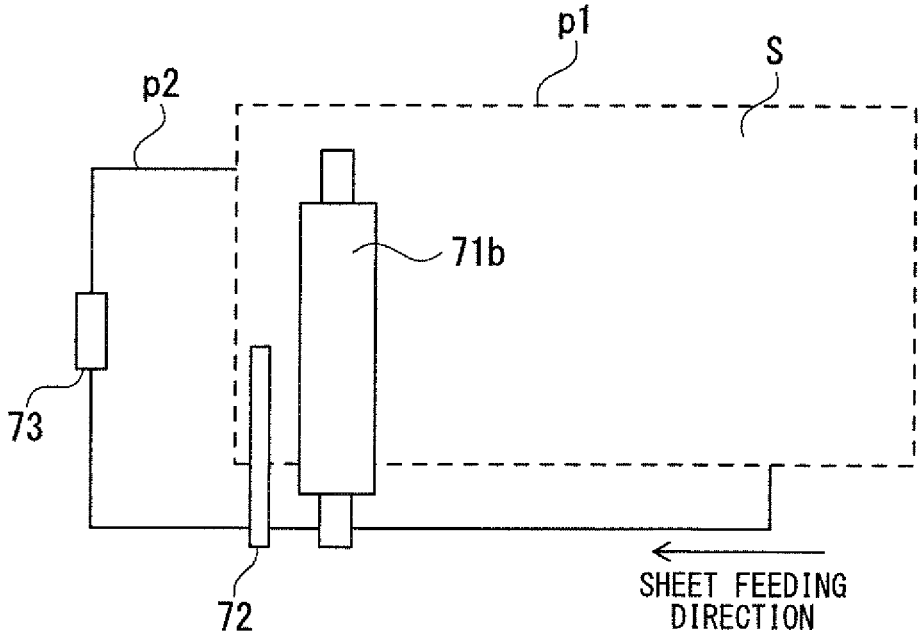
FIG. 2 is a plan view illustrating a positional relationship of a registration roller pair, a deviation detection sensor, and a leading end detection sensor according to the embodiment of the present invention.

FIG. 2 is a plan view illustrating a positional relationship between the registration roller pair 71 and the deviation detection sensor 72 and the leading end detection sensor 73 and shows a state in which each portion is seen from above.

In the vicinity of the downstream side in the sheet feeding direction of the registration roller pair 71, the deviation detection sensor 72 is disposed. Moreover, away from the deviation detection sensor 72 by a predetermined distance on the downstream side in the sheet feeding direction, the leading end detection sensor 73 is disposed.

The registration roller pair 71 swings in the sheet width direction orthogonal to the sheet feeding direction in a state nipping the sheet S in the nip portion in accordance with a detection result of the deviation detection sensor 72. As a result, deviation in the sheet width direction of the sheet is modified. After swing is finished, when attention is paid to the sheet width direction of the sheet S, the sheet S is moved by the registration roller pair 71 from a deviated position p1 indicated by a broken line in the figure to a position p2 indicated by a solid line at which the deviation in the sheet width direction is modified. Subsequently, the leading end detection sensor 73 disposed away by the predetermined distance on the downstream side in the sheet feeding direction of the deviation detection sensor 72 detects a leading end of the sheet in the state where deviation has been modified. After a predetermined time has elapsed since detection of the leading end of the sheet, the sheet reaches the transfer position of the secondary transfer portion 60.

[Configuration of Control System of Image Forming Apparatus]

Subsequently, a control system of the image forming apparatus 1 will be described by referring to FIG. 3.

Figure 3:
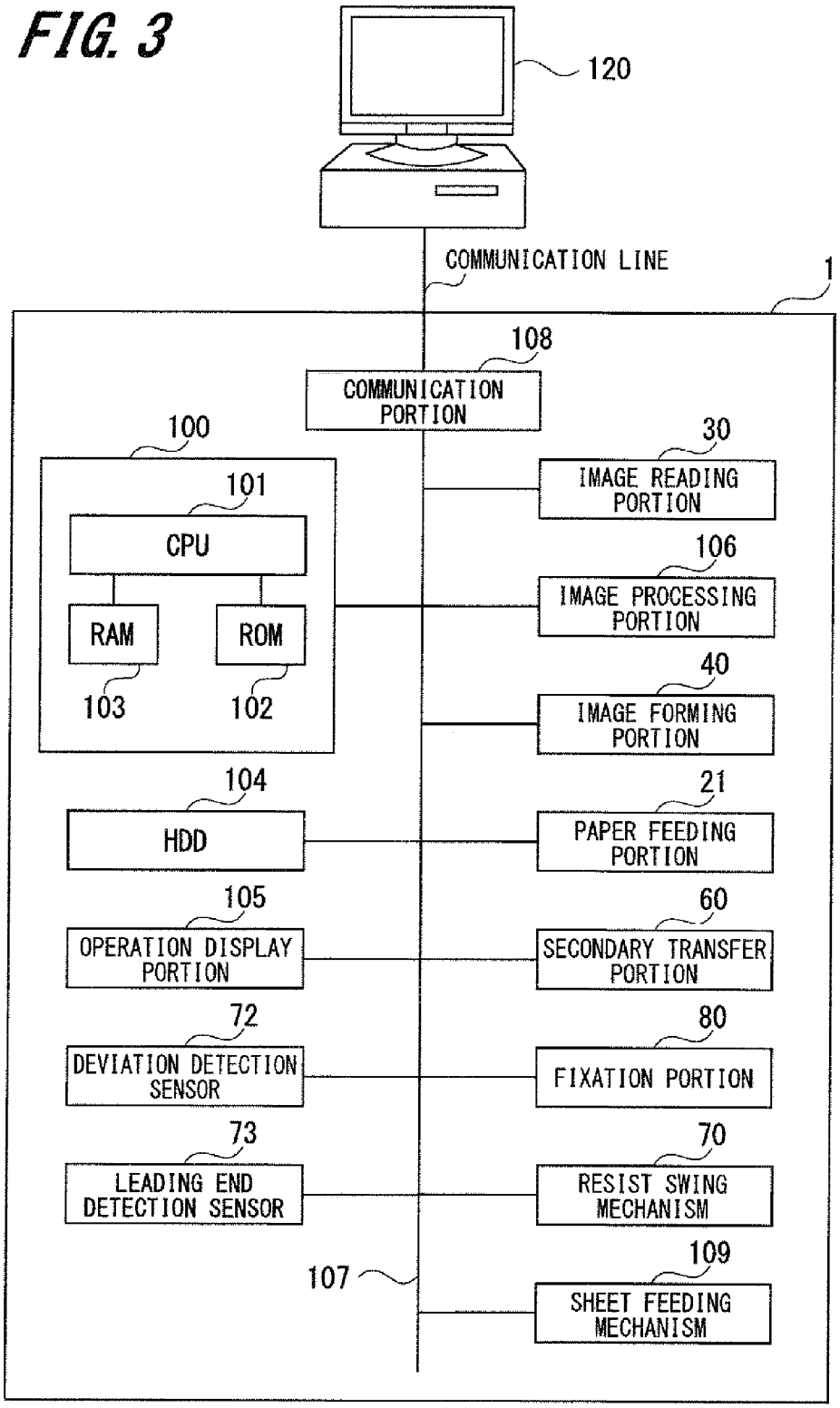
FIG. 3 is a block diagram illustrating hardware configuration of each portion of the image forming apparatus according to the embodiment of the present invention.

FIG. 3 is a block diagram illustrating the control system of the image forming apparatus 1.

As illustrated in FIG. 3, the image forming apparatus 1 is provided with the control portion 100. The control portion 100 is connected to a communication portion 108, the image reading portion 30, an image processing portion 106, the image forming portion 40, the paper feeding portion 21, the secondary transfer portion 60, the fixation portion 80, the resist swing mechanism 70, and a sheet feeding mechanism 109 through a system bus 107. Moreover, the control portion 100 is connected to an HDD 104, an operation display portion 105, the deviation detection sensor 72, and the leading end detection sensor 73 through the system bus 107.

The control portion 100 has a CPU (Central Processing Unit) 101, a ROM (Read Only Memory) 102 for storing a program executed by the CPU 101 and the like, and a RAM (Random Access Memory) 103 used as a work area of the CPU 101, for example. As the ROM 102, a programmable ROM which is usually electrically erasable, for example, is used. The control portion 100 controls each block, that is, the entire apparatus.

The HDD 104 stores image data of a manuscript image obtained by reading by the image reading portion 30 and stores outputted image data and the like. The operation display portion 105 is a touch panel composed of a liquid crystal display device (LCD) or a display of an organic ELD (Electro Luminescence Display) and the like. This operation display portion 105 displays an instruction menu for a user and information relating to the obtained image data and the like. Moreover, the operation display portion 105 is provided with a plurality of keys, receives inputs of data such as various instructions, characters, numerals and the like by a key operation of a user and outputs an input signal to the control portion 100.

The image data created by the image reading portion 30 and the image data transmitted from a PC (Personal Computer) 120 which is an example of an external device connected to the image forming apparatus 1 are sent to the image processing portion 106 and subjected to image processing. The image processing portion 106 applies processing such as analog processing, A/D conversion, shading correction, image compression and the like to the received image data.

The communication portion 108 receives job information transmitted from the PC 120 which is an external information processor through a communication line. Subsequently, the communication portion 108 sends the received job information to the control portion 100 through the system bus 107.

The resist swing mechanism 70 of the present embodiment is, as described above, composed of the registration roller pair 71, the swing driving portion, not shown, and the roller driving portion. The resist swing mechanism 70 is driven and controlled by the control portion 100, swings the registration roller pair 71 by the swing mechanism portion, and rotates the driving roller 71*a* by the roller driving portion. Usually, the roller driving portion stops the driving roller 71*a* when the leading end of the sheet is brought into contact with the nip portion of the registration roller pair 71 and rotates the driving roller 71*a* other than that. The swing driving portion returns the registration roller pair 71 to a reference position in the sheet width direction after the rear end of the sheet has passed the nip portion of the registration roller pair 71.

The sheet feeding mechanism 109 is driven and controlled by the control portion 100 and feeds the sheet S on which an image is to be formed. This sheet feeding mechanism 109 is composed of rollers arranged between the paper feeding portion 21 and the secondary transfer portion 60 of the image forming apparatus 1 and rotation driving portions (not shown) rotating the respective rollers. As a rotation driving portion, one combining a motor and various mechanisms or various actuators can be employed. The control portion 100 controls rotation of each roller of the sheet feeding mechanism 109 and adjusts a feeding speed of the sheet S to be fed from the paper feeding portion 21 to the secondary transfer portion 60.

The deviation detection sensor 72 is driven and controlled by the control portion 100 and has a function as a deviation detecting portion for detecting deviation from a reference position of the sheet being fed. The deviation detection sensor 72 cyclically reads a position of one side end portion in parallel with the sheet feeding direction and outputs read-out information to the control portion 100. The control portion 100 calculates a deviation direction (displacement direction) and a deviation amount (displacement amount) of the sheet from the reference position on the basis of the information received form the deviation detection sensor 72. Subsequently, on the basis of the calculation result, the control portion 100 determines a direction to swing the registration roller pair 71 and a swing amount thereof and outputs a control signal including an instruction based on this determination to the swing driving portion.

For the deviation detection sensor 72, a line sensor in which a plurality of photoelectric conversion elements is linearly aligned in the sheet width direction or an image sensor in which photoelectric conversion elements are arranged in a matrix state is used. As the line sensor and image sensor, a CCD image sensor or a CMOS (including MOS) image sensor can be used.

The leading end detection sensor 73 is driven and controlled by the control portion 100 and has a function as a leading end detecting portion for detecting a leading end of the sheet being fed. The leading end detection sensor 73 cyclically reads presence of passage of the leading end of a sheet and outputs read-out information to the control portion 100. The control portion 100 determines whether the leading end of the sheet has passed immediately below the leading end detection sensor 73 or not on the basis of information received from the leading end detection sensor 73. If the leading end of the sheet has passed immediately below the leading end detection sensor 73, the control portion 100 controls the rollers so that the sheet reaches the transfer position of the secondary transfer portion 60 after predetermined time has elapsed since detection of the leading end of the sheet.

For the leading end detection sensor 73, a transmissive photosensor in which a light emitting member and a light receiving member are arranged facing with each other or a reflective photosensor for detecting reflective light of emitted light by an object is used, for example.

In the present embodiment, the example in which a personal computer is applied as an external device is described, but this is not limiting, and any other various devices such as a facsimile device and the like may be applied, for example, as an external device.

[Operation of Image Forming Apparatus]

An outline of an operation of the image forming apparatus 1 will be described below.

Figure 4:
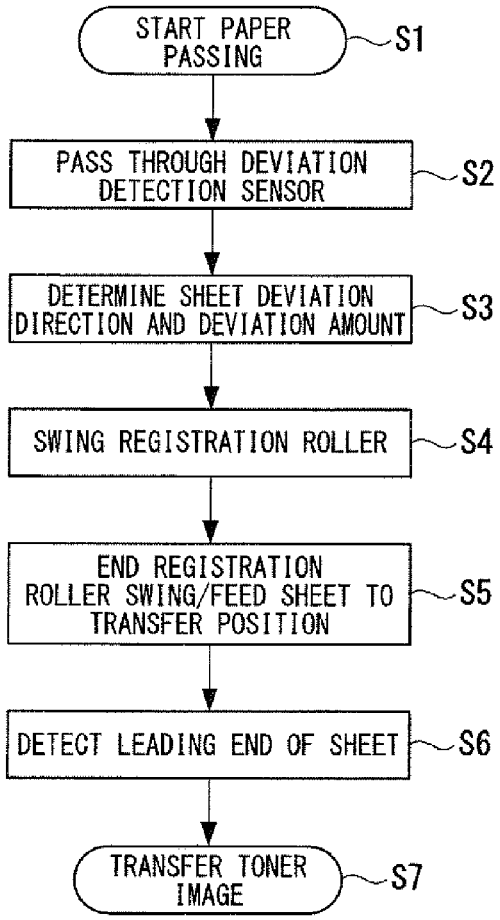
FIG. 4 is a flowchart illustrating image formation processing according to the embodiment of the present invention.

FIG. 4 is a flowchart illustrating image formation processing in the image forming apparatus 1.

First, the control portion 100 of the image forming apparatus 1 detects job start relating to image formation on the basis of an operation signal inputted from the operation display portion 105 or job information transmitted from the PC 120 through the communication portion 108. When the control portion 100 detects the job start relating to image formation, the control portion 100 operates the paper feeding portion 21, for example, supplies a sheet from the sheet accommodating portion 20 and starts paper passing (Step S1).

After the start of paper feeding, the sheet is fed by the sheet feeding mechanism 109, and the leading end of the sheet is brought into contact with the nip portion of the registration roller pair 71 whose rotation is stopped. Subsequently, an attitude and feeding timing of the sheet are adjusted. Subsequently, the control portion 100 rotates the driving roller 71*a* of the registration roller pair 71, and the driven roller 71*b* rotates accordingly. The leading end of the sheet enters the nip portion of the registration roller pair 71, and the sheet further passes immediately below the deviation detection sensor 72 (Step S2).

At this time, the deviation detection sensor 72 detects a position of one side end portion of the sheet and outputs it to the control portion 100. The control portion 100 determines a deviation direction and a deviation amount of the sheet from the detection result by the deviation detection sensor 72 (Step S3).

The control portion 100 outputs a control signal to the swing driving portion of the resist swing mechanism 70 on the basis of the deviation direction and the deviation amount of the sheet, swings the registration roller pair 71 and modifies the deviation (Step S4). At this time, the CPU 101 reads information of the registration roller swing speed stored in a register inside the CPU 101 or the ROM 102 and swings the registration roller pair 71 at this registration roller swing speed.

After the swing of the registration roller pair 71 is finished, the control portion 100 outputs a control signal to the sheet feeding mechanism. 109 and feeds the sheet whose deviation has been modified to the secondary transfer nip portion 62 which is a transfer position of the secondary transfer portion 60 (Step S5).

The leading end detection sensor 73 disposed on the downstream side in the sheet feeding direction of the deviation detection sensor 72 detects a leading end of a sheet (Step S6) and outputs the detection result to the control portion 100.

After the leading end detection sensor 73 detects the leading end of the sheet, the control portion 100 outputs a control signal to the sheet feeding mechanism 109 and feeds the sheet to the transfer position after predetermined time has elapsed since the leading end of the sheet is detected by the leading end detection sensor 73. That is, it is controlled such that the sheet reaches the transfer position after certain time has elapsed since start of paper passing. Then, a toner image formed on the intermediate transfer belt 50 is transferred to the sheet having been fed to the transfer position without dislocation and with accuracy (Step S7).

In the above present embodiment described above, the leading end detection of the sheet by the leading end detection sensor 73 is executed after swing (deviation modification) of the registration roller pair 71 is completed. By employing such configuration, with the same paper type and paper size in the leading end detection sensor 73, the leading end of the sheet can be detected at the same position in the sheet width direction all the time. Thus, control (timing) from detection of the leading end of the sheet to positioning of the sheet with the toner image is made stable. Therefore, variation in a detected position or detection timing of the leading end of the sheet according to the outer shape of the sheet is reduced. Moreover, if the sheet of the similar type and size is to be continuously passed, the position and timing in the sheet width direction of the leading end of the sheet read by the leading end detection sensor is made stable for each sheet. As a result, accuracy of positioning of the sheet with the toner image is improved, and an image without dislocation can be formed on the sheet.

[Modification 1]

Subsequently, a Modification 1 of the embodiment of the present invention will be described.

Figure 5:
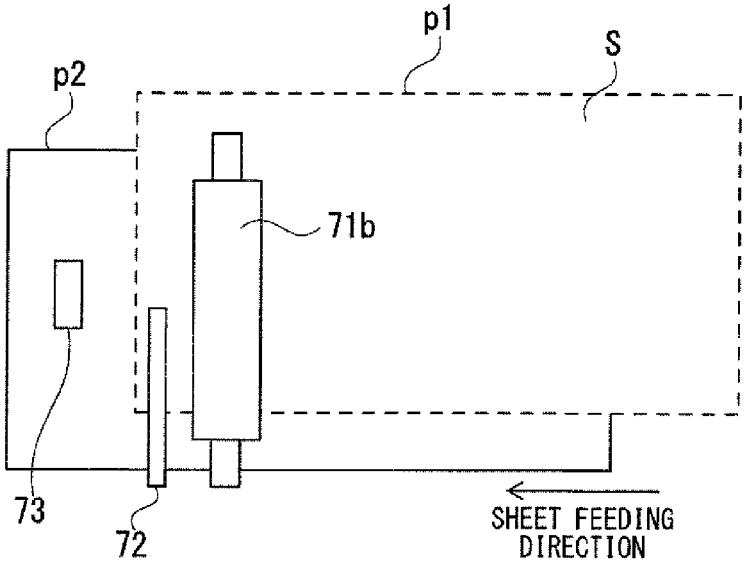
FIG. 5 is an explanatory diagram illustrating a state in which a distance between the registration roller pair and the leading end detection sensor illustrated in FIG. 3 is reduced.

As illustrated in FIG. 5, by disposing the leading end detection sensor 73 as close as possible to the deviation detection sensor 72, an increase in the apparatus size can be suppressed. However, if the leading end detection sensor 73 is simply brought close to the deviation detection sensor 72, swing of the registration roller pair 71 might not be performed in time. As a measure against it, control of varying the swing speed of the registration roller pair 71 is executed by the control portion 100 in accordance with the position of the leading end detection sensor 73. For example, the swing speed of the registration roller pair 71 by the swing driving portion of the resist swing mechanism 70 is made faster than a reference swing speed.

According to this Modification 1, only by executing simple control of increasing the swing speed of the registration roller pair 71, the leading end detection sensor 73 can be brought close to the deviation detection sensor 72, and the size of the apparatus can be reduced. The faster the swing speed of the registration roller pair 71 is, the smaller the distance between the leading end detection sensor 73 and the deviation detection sensor 72, that is, the registration roller pair 71 can be made.

Meanwhile, from the viewpoint of stable deviation modification of the sheet, the swing speed of the registration roller pair 71 is slower the better. Thus, the control of increasing the swing speed of the registration roller pair 71 may be executed only if the deviation amount of the sheet detected by the deviation detection sensor 72 is large.

Figure 6:
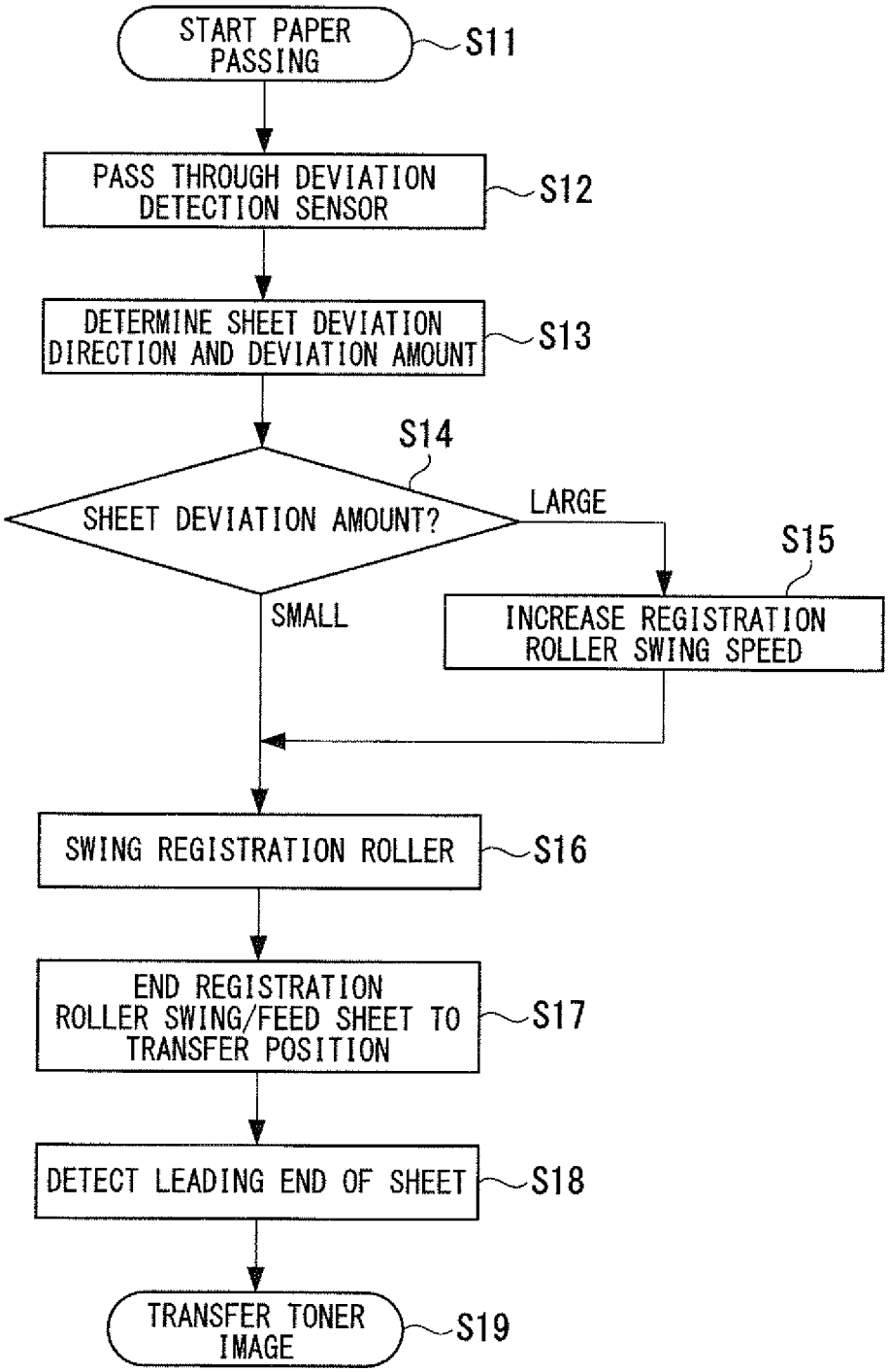
FIG. 6 is a flowchart illustrating the image formation processing according to a Modification 1 of the embodiment of the present invention.

FIG. 6 is a flowchart illustrating control of increasing the swing speed of the registration roller pair 71 if the deviation amount of the sheet is large as a variation of the image forming processing in the image forming apparatus 1.

First, processing at Step S11 to Step S13 is executed. The processing at Step S11 to Step S13 is similar to the processing at Step S1 to Step S3 in FIG. 4 and thus, the description will be omitted.

Subsequently, it is determined whether or not the deviation amount of the sheet acquired in the processing at Step S13 is larger than a threshold value (Step S14). If the deviation amount of the sheet is smaller than the threshold value (deviation amount small), the process proceeds to processing at Step S16. On the other hand, if the deviation amount of the sheet is equal to or larger than the threshold value (deviation amount large), the control portion 100 increases the swing speed of the registration roller pair 71 (Step S15).

Specifically, a registration roller swing sped faster than the normal registration roller swing speed used if the deviation amount of the sheet is larger than the threshold value is stored in the register in the CPU 101 or the ROM 102, and this is read out by the CPU 101. Alternatively, it may be so configured that the CPU 101 reads out the normal registration roller swing speed stored in the register in the CPU 101 or the ROM 102, and the swing of the registration roller pair 71 is performed with this registration roller swing speed added with a predetermined speed.

If the deviation amount of the sheet is equal to or larger than the threshold value in the determination processing at Step S14, or after the registration roller swing speed is increased in the processing at Step S15, the control portion 100 swings the registration roller pair 71 and modifies the deviation (Step S16).

After the registration roller pair 71 swings and the deviation of the sheet is modified, processing at Step S17 to Step S19 is executed. The processing at Step S17 to Step S19 is similar to the processing at Step S5 to Step S7 in FIG. 4 and thus, the description will be omitted.

In the above described Modification 1, the swing speed of the registration roller pair 71 is increased if the deviation amount of the sheet is large and thus, even if the leading end detection sensor 73 is brought close to the deviation detection sensor 72, the sheet reaches the leading end detection sensor 73 after the swing is completed. Therefore, even if the deviation amount of the sheet is large, the leading end of the sheet can be detected at the same position in the sheet width direction of the sheet for each sheet in the leading end detection sensor 73. Moreover, control (timing) from detection of the leading end of the sheet to the positioning of the sheet with the toner image transferred onto the intermediate transfer belt 50 is made stable.

Moreover, if the deviation amount of the sheet is small, the registration roller pair 71 can be made to swing at a normal swing speed and thus, in the case of a normal deviation amount, there is an effect that deviation modification of the sheet can be reliably executed in addition to the aforementioned effect. In this example, the deviation amounts of the sheet are divided into large and small, but the deviation amount of the sheet may be divided into three stages, that is, large, medium and small or more, and the swing speed may be controlled in accordance with the respective threshold values.

[Modification 2]

Subsequently, a Modification 2 of the embodiment of the present invention will be described.

In this Modification 2, control of changing the feeding speed of the sheet to be fed to the transfer position as appropriate is executed by the control portion 100 (an example of the feeding speed control portion). Two examples for keeping constant a time since paper passing is started until the sheet is fed to the transfer position (hereinafter referred to as "process time") by changing the feeding speed of the sheet will be described.

(First Example of Modification 2)

As a first example of the Modification 2, control of increasing the feeding speed of the sheet until the sheet reaches the leading end detection sensor 73 will be described below.

Figure 7:
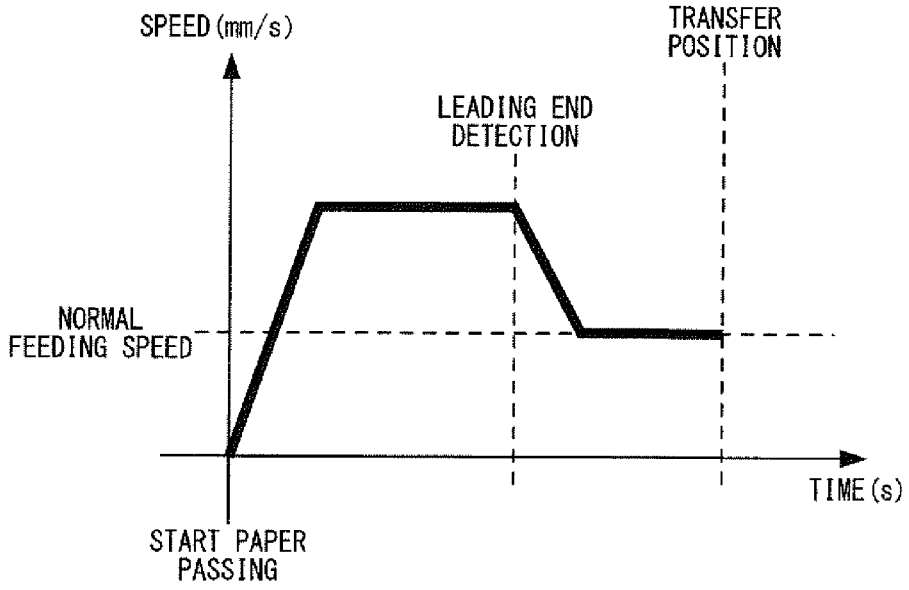
FIG. 7 is a graph illustrating a first example of a change in a feeding speed of a sheet according to a Modification 2 of the embodiment of the present invention.

FIG. 7 is a graph illustrating the first example of a change in the feeding speed of the sheet according to the Modification 2 of the embodiment. In FIG. 7, the lateral axis indicates time (s) and the vertical axis indicates a speed (mm/s).

In this example, the feeding speed of the sheet is accelerated until the feeding speed of the sheet becomes a predetermined feeding speed set to a speed faster than a normal feeding speed from start of the paper passing. Subsequently, the predetermined feeding speed is maintained, and after the leading end of the sheet is detected by the leading end detection sensor 73, the feeding speed of the sheet is lowered to the normal feeding speed, and the sheet is fed at the normal feeding speed to the transfer position.

As described above, in the embodiment and its Modification 1 of the present invention, the leading end detection sensor 73 is disposed on the downstream side in the sheet feeding direction of the deviation detection sensor 72. Thus, time difference is caused from detection of the deviation by the deviation detection sensor 72 to detection of the leading end of the sheet by the leading end detection sensor 73, and as a result, process time becomes long. In general, in the image forming apparatus, process time is shorter the better, and time specified in advance is preferably maintained.

If control is executed as illustrated in FIG. 7, time from start of paper passing to detection of the leading end of the sheet by the leading end detection sensor 73 can be reduced. Thus, if the leading end detection sensor 73 is disposed on the downstream side of the deviation detection sensor 72, the entire process time can be maintained constant. In this case, since the feeding speed of the sheet is faster than usual, rotation of the driving roller 71*a* of the registration roller pair 71 is also quickened accordingly.

(Second Example of Modification 2)

As a second example of the Modification 2, control of increasing the feeding speed of the sheet from end of swing of the registration roller pair 71 to detection of the leading end by the leading end detection sensor 73 will be described.

Figure 8:
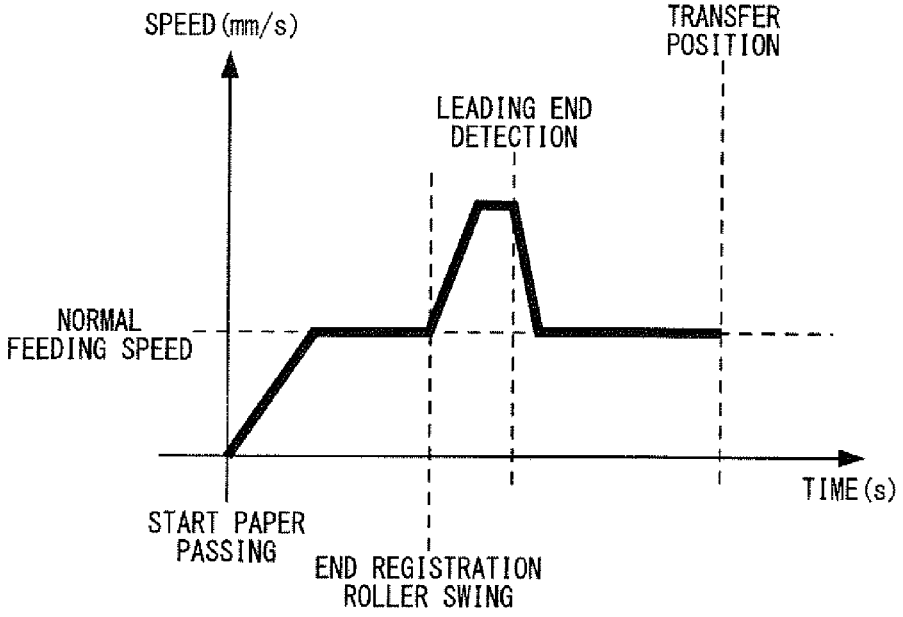
FIG. 8 is a graph illustrating a second example of a change in a feeding speed of a sheet according to the Modification 2 of the embodiment of the present invention.
Figure 9:
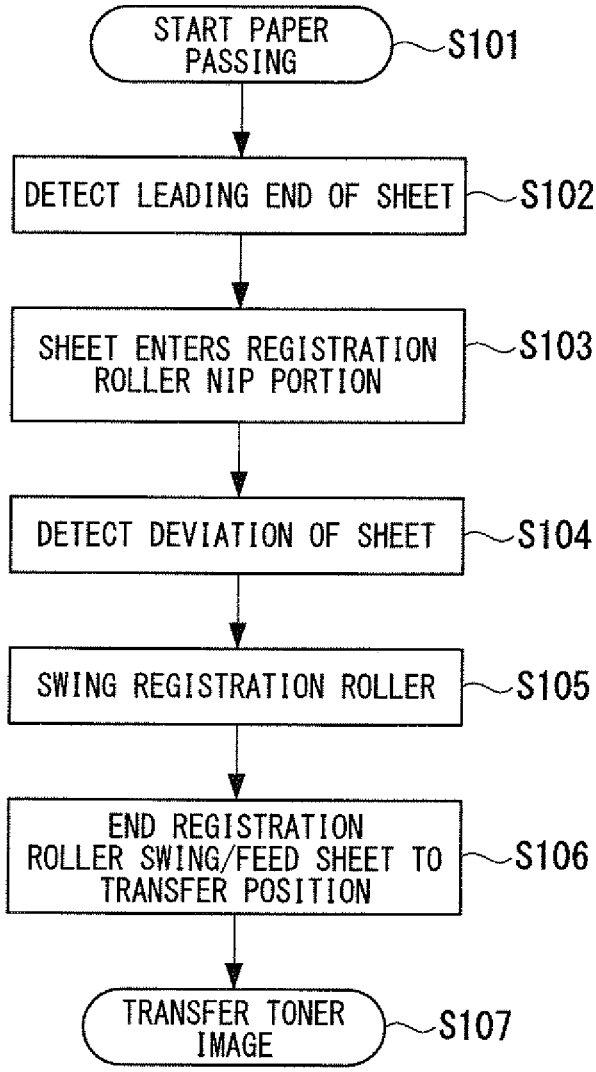
FIG. 9 is a flowchart illustrating an outline of prior-art paper feeding processing.

FIG. 8 is a graph illustrating a second example of a change in the feeding speed of the sheet according to the Modification 2 of the embodiment. In FIG. 8, the lateral axis indicates time (s) and the vertical axis indicates a speed (mm/s).

In this example, the feeding speed of the sheet is accelerated to the normal feeding speed from start of paper passing and the normal feeding speed is maintained until swing of the registration roller pair 71 is finished. The feeding speed of the sheet is accelerated to a predetermined feeding speed faster than the normal feeding speed from a point of time when the swing of the registration roller pair 71 is finished, and this predetermined feeding speed is maintained until detection of the leading end of the sheet by the leading end detection sensor 73 is finished. After the leading end of the sheet is detected by the leading end detection sensor 73, the feeding speed of the sheet is lowered to the normal feeding speed, and the sheet is fed at the normal feeding speed to the transfer position.

If control is executed as described above, time from end of swing of the registration roller pair 71 to detection of the leading end by the leading end detection sensor 73 can be reduced. Thus, even if the leading end detection sensor 73 is disposed on the downstream side of the deviation detection sensor 72, and the feeding speed to the registration roller pair 71 is set to the normal feeding speed, the entire process time can be maintained constant.

In FIG. 8, the example in which the feeding speed of the sheet is increased from the end of swing of the registration roller pair 71 to detection of the leading end by the leading end detection sensor 73 is illustrated, but this example is not limiting. It is only necessary that the feeding speed is increased in a section which is a part of the feeding path at least from start of paper passing until the sheet is fed to the transfer position.

For example, the feeding speed of the sheet up to the transfer position after swing of the registration roller pair 71 is finished may be set faster than the normal feeding speed. When the case in which the feeding speed of the sheet is increased after the end of swing to detection of the leading end by the leading end detection sensor 73 is compared with the case in which the feeding speed of the sheet is increased up to the transfer position, a change width of the feeding speed can be small in the latter case. Thus, a load on the rotation driving portion of the sheet feeding mechanism 109 or an influence such as skew of the sheet or the like along with the change of the feeding speed can be reduced.

In the image forming apparatus having the aforementioned configuration, leading end detection of the sheet by the leading end detecting portion is performed after swing of the registration roller (deviation modification) is completed. As a result, the leading end of the sheet can be detected at the same position in the sheet width direction. Moreover, control (timing) from detection of the leading end of the sheet to positioning of the sheet with the toner image is stable.

The embodiments to which the invention made by the present inventor is applied have been described. However, the present invention is not limited by description and drawings forming apart of disclosure of the invention by the aforementioned embodiments and is capable of various variations within a range not departing from the gist of the invention described in appended claims.

In the aforementioned embodiment and its variations, the example in which the present invention is applied to feeding of the sheet to the secondary transfer portion 60 was described, but the present invention is not limited to this example. The present invention can be applied to an image forming apparatus provided with a configuration for feeding a sheet whose deviation was modified by a registration roller pair to the transfer position and can be also applied to an image forming apparatus provided with a photoreceptor as an image carrier and a toner image is directly transferred to a sheet from the photoreceptor, for example.

What is claimed is:

1. An image forming apparatus comprising:

a deviation detecting portion for detecting a deviation amount of a sheet being fed from a reference position in a sheet width direction orthogonal to a feeding direction;

a registration roller for modifying deviation in the sheet width direction of the sheet being fed by swinging in the sheet width direction in accordance with the deviation amount detected by the deviation detecting portion;

a leading end detecting portion disposed on the downstream side in the sheet feeding direction of the registration roller and detecting a leading end of the sheet being fed;

a control portion for controlling a swing speed of the registration roller; and a feeding speed control portion for executing control of changing the feeding speed of the sheet being fed to a transfer position where a toner image formed on an image carrier is transferred, wherein the leading end detecting portion detects the leading end of the sheet after the deviation is modified by the registration roller, the control portion increases the swing speed of the registration roller when the deviation amount of the sheet detected by the deviation detecting portion exceeds a threshold value, and the feeding speed control portion controls the feeding speed of the sheet being fed to be accelerated to a first speed at an onset of feeding the sheet and maintained at the first speed until the swinging of the registration roller is completed, accelerated to a second speed faster than the first speed when the swinging of the registration roller is completed and maintained at the second speed until the leading end of the sheet is detected by the leading end detecting portion, and lowered from the second speed to the first speed after the leading end of the sheet is detected by the leading end detecting portion.

2. An image forming apparatus comprising:

a deviation detecting portion for detecting a deviation amount of a sheet being fed from a reference position in a sheet width direction orthogonal to a feeding direction;

a roller for modifying deviation in the sheet width direction of the sheet being fed by swinging in the sheet width direction in accordance with the deviation amount detected by the deviation detecting portion;

a leading end detecting portion disposed on the downstream side in the sheet feeding direction of the roller and detecting a leading end of the sheet being fed;

a control portion for controlling a swing speed of the roller; and a feeding speed control portion for executing control of changing the feeding speed of the sheet being fed to a transfer position where a toner image formed on an image carrier is transferred, wherein the leading end detecting portion detects the leading end of the sheet after the deviation is modified by the roller, the control portion increases the swing speed of the roller when the deviation amount of the sheet detected by the deviation detecting portion exceeds a threshold value, and the feeding speed control portion controls the feeding speed of the sheet being fed to be accelerated to a first speed at an onset of feeding the sheet and maintained at the first speed until the swinging of the roller is completed, accelerated to a second speed faster than the first speed when the swinging of the roller is completed and maintained at the second speed until the leading end of the sheet is detected by the leading end detecting portion, and lowered from the second speed to the first speed after the leading end of the sheet is detected by the leading end detecting portion.

3. An image forming apparatus comprising:

a deviation detecting portion for detecting a deviation amount of a sheet being fed from a reference position in a sheet width direction orthogonal to a feeding direction;

a roller for adjusting an attitude of the sheet being fed by stopping rotation thereof when the sheet is brought into contact with the roller and modifying deviation in the sheet width direction of the sheet being fed by swinging in the sheet width direction in accordance with the deviation amount detected by the deviation detecting portion;

a leading end detecting portion disposed on the downstream side in the sheet feeding direction of the roller and detecting a leading end of the sheet being fed; and a control portion for controlling a swing speed of the roller, a feeding speed control portion for executing control of changing the feeding speed of the sheet being fed to a transfer position where a toner image formed on an image carrier is transferred, wherein the leading end detecting portion detects the leading end of the sheet after the deviation is modified by the roller, the control portion increases the swing speed of the roller when the deviation amount of the sheet detected by the deviation detecting portion exceeds a threshold value, and the feeding speed control portion controls the feeding speed of the sheet being fed to be accelerated to a first speed at an onset of feeding the sheet and maintained at the first speed until the swinging of the roller is completed, accelerated to a second speed faster than the first speed when the swinging of the roller is completed and maintained at the second speed until the leading end of the sheet is detected by the leading end detecting portion, and lowered from the second speed to the first speed after the leading end of the sheet is detected by the leading end detecting portion.

* * * * *